US005315274A

United States Patent [19]

Särkkä

[11] Patent Number: 5,315,274

[45] Date of Patent: May 24, 1994

[54] DIELECTRIC RESONATOR HAVING A DISPLACEABLE DISC

[75] Inventor: Veli-Matti Särkkä, Oulunsalo, Finland

[73] Assignee: Nokia Telecommunications OY, Espoo, Finland

[21] Appl. No.: 960,403

[22] Filed: Jan. 7, 1993

[30] Foreign Application Priority Data

May 9, 1991 [FI] Finland ..... 912256

[51] Int. Cl.[5] ..... H01P 7/10

[52] U.S. Cl. ..... 333/219.1; 333/235

[58] Field of Search ..... 333/202, 219, 219.1, 333/235, 234; 331/96, 107 DP, 117 D

[56] References Cited

U.S. PATENT DOCUMENTS

| | | | |
|---|---|---|---|
| 3,798,578 | 3/1974 | Konishi et al. | 333/202 X |
| 4,565,979 | 1/1986 | Fiedziuszko | 331/117 D |
| 4,580,116 | 4/1986 | Ballato | 333/234 |
| 4,849,722 | 7/1989 | Cruchon et al. | 333/205 |
| 5,200,721 | 4/1993 | Mansour | 333/219.1 X |

FOREIGN PATENT DOCUMENTS

| | | | |
|---|---|---|---|
| 1259307 | 9/1986 | U.S.S.R. | 333/202 |

OTHER PUBLICATIONS

Fiedziuszko, "Microwave Dielectric Resonators", Microwave Journal, Sep. 1986, pp. 189–198.

Pospieszalski, "Cylindrical Dielectric Resonators . . . Microwave Circuits", IEEE Trans. on Microwave Theory & Tech. vol. MTT-27, No. 3, Mar. 1979, pp. 233–238.

Kuchler, "Ceramic Resonators for Highly Stable Oscillators", Siemens Components XXIV, 1989, No. 5, pp. 180–183.

*Primary Examiner*—Seungsook Ham

*Attorney, Agent, or Firm*—Cushman, Darby & Cushman

[57] ABSTRACT

The invention relates to a dielectric resonator (3) comprising two cylindrical discs made of a dielectric material. In the invention, the discs (3A,3B) are positioned with their planar surfaces against each other, so that they are radially displaceable with respect to each other for varying the shape of the resonator (3) and for adjusting the resonance frequency (3).

18 Claims, 1 Drawing Sheet

DIELECTRIC RESONATOR HAVING A DISPLACEABLE DISC

FIELD OF THE INVENTION

The invention relates to a dielectric resonator comprising two cylindrical discs made of a dielectric material.

BACKGROUND OF THE INVENTION

Among high-frequency and microwave resonator structures, so-called dielectric resonators have recently become increasingly interesting as they offer e.g. the following advantages over conventional resonator structures: smaller circuit sizes, higher integration level, higher efficiency and lower cost of manufacture. Any element having a simple geometric shape made of a material having low dielectric losses and a high relative dielectric constant can be used as a high Q dielectric resonator. For reasons of the manufacturing technique, the dielectric resonator is usually cylindrical, such as a cylindrical disc.

The structure and operation of dielectric resonators are described e.g. in the following articles:

[1] *Ceramic Resonators for Highly Stable Oscillators,* Gundolf Kuchler, Siemens Components XXIV (1989) No. 5, p. 180–183.

[2] *Microwave Dielectric Resonators,* S. Jerry Fiedziuszko, Microwave Journal, September 1986, p. 189–191.

[3] *Cylindrical Dielectric Resonators and their Applications in TEM Line Microwave Circuits,* Marian W. Pospieszalski, IEEE Transactions on Microwave Theory and Techniques, VOL. MTT-27, No. 3, March 1979, p. 233–238.

The resonance frequency of the dielectric resonator is primarily determined by the dimensions of the resonator element. Another factor affecting the resonance frequency is the surroundings of the resonator. The electric or magnetic field of the resonator and, thus, the resonance frequency can be intentionally affected by introducing a metal surface or any other conductive surface in the vicinity of the resonator. To adjust the resonance frequency of the dielectric resonator, a common practice is to adjust the distance between the conductive metal surface and the planar surface of the resonator. The adjusting mechanism may be e.g. an adjustment screw attached to the housing surrounding the resonator.

In this kind of adjusting method, however, it is typical that the resonance frequency varies nonlinearly as a function of the adjusting distance. Due to the nonlinearity and the steepness of the adjustment, it is difficult and requires high precision to accurately adjust the resonance frequency, especially in the upper end of the adjusting range. In addition, the unloaded Q-factor varies as a function of the distance between the conductive surface and the resonator.

A constant Q-factor and a more linear frequency adjustment can be obtained within a wider range by replacing the conductive adjustment surface or plate with a dielectric adjustment plate wherein the distance from the planar surface of the resonator is adjusted. FIG. 7 in the above-mentioned article [2] shows a so-called double resonator structure as a modification of this solution. In the double resonator structure, two cylindrical dielectric resonator discs are positioned co-axially close to each other so that the distance between their planar surfaces can be adjusted by displacing the discs in the direction of their common axis. Also, in this case, the adjustment curve is still steep. In addition the double resonator structure is larger and more complicated than a conventional structure utilizing an adjustment plate.

SUMMARY OF THE INVENTION

The object of the invention is a dielectric resonator structure in which the resonance frequency can be adjusted more accurately than previously.

This is achieved by means of a dielectric resonator according to the invention, wherein the discs are positioned with their planar surfaces against each other, and the discs are radially displaceable with respect to each other for adjusting the resonance frequency of the resonator.

The basic idea of the invention is that the virtually integral resonator comprises two dielectric discs positioned against each other. When the discs are displaced radially with respect to each other, the shape of the resonator varies with resultant variation in the normal field patterns of the electric and magnetic fields of the resonator, which, in turn, affects the resonance frequency. The invention provides a relatively linear resonance frequency adjustment curve which is more gently sloping than previously available while the unloaded Q-factor of the resonator remains at a high constant value during the adjustment. The accuracy of the temperature compensation is also independent of the adjustment of the resonance frequency. The mechanical structure of the resonator is simpler and its size is smaller than prior art resonators.

BRIEF DESCRIPTION OF THE DRAWINGS

In the following the invention will be described in greater detail by means of illustrating embodiments with reference to the attached drawings, in which.

DETAILED DESCRIPTION OF THE PREFERRED EXEMPLARY EMBODIMENTS

As used herein, the term dielectric resonator refers generally to any body or element of a suitable geometric shape and made of a material of low dielectric losses having a high relative dielectric constant. For reasons of manufacturing technique, the dielectric resonator is usually cylindrical, such as a cylindrical disc. The most commonly used material is ceramic.

The structure, operation and ceramic materials of dielectric resonators are described e.g. in the above-mentioned articles [1], [2] and [3], which are incorporated in the present application for reference. In the text below the structure of the dielectric resonator will be described.

Figure 1:
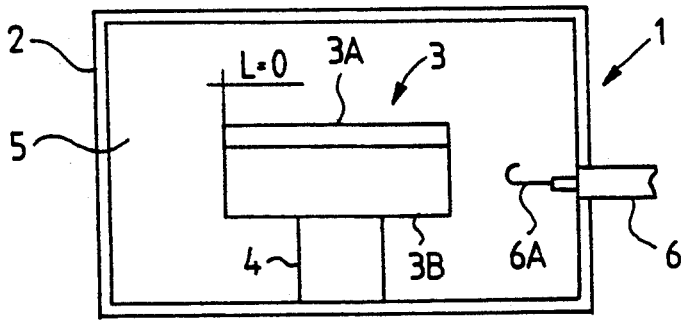
FIGS. 1 and 2 are sectional side views of a dielectric resonator according to the invention in two different positions of the dielectric discs.

FIG. 1 shows a dielectric resonator structure according to the preferred embodiment of the invention, comprising a dielectric, cylindrical resonator 3 positioned in a cavity 5 defined by a housing 2 made of an electrically conductive material (such as metal). The housing 2 is connected to ground potential. The dielectric resonator 3, typically made of a ceramic material, is positioned at a fixed distance from the bottom of the housing 2 and supported on a support foot 4 made of a suitable dielectric or insulation material, such as polystyrene.

The electromagnetic fields of the dielectric resonator extend outside the resonator body so that, depending on the application, the resonator can be electromagnetically connected to another resonator circuit in various ways, such as by a microstrip conductor, a bent coaxial conductor, or a conventional straight conductor positioned close to the resonator. In the example of FIG. 1, the connection to the resonator 3 is made by means of a bent inner conductor 6A of a coaxial cable 6.

The resonance frequency of the dielectric resonator is determined mainly by the dimensions of the resonator element. Another factor affecting the resonance frequency is the surroundings of the resonator. By bringing a metal surface or some other conductive surface close to the resonator element, the electric or magnetic field of the resonator can be intentionally affected, thereby changing the resonance frequency. A similar effect is produced when a dielectric electric body is brought close to the resonator except that the unloaded Q-factor of the resonator does not vary in this case.

The resonator 3, according to the invention, comprises two cylindrical discs 3A and 3B made of a dielectric material, such as ceramic. The discs 3A and 3B are positioned with their planar surfaces against each other so that the discs are radially displaceable with respect to each other. In the preferred embodiment of the invention, the disc 3B is substantially thicker than the disc 3A. The lower surface of the thicker disc 3B is fixed to the support foot while the uppermost thinner disc 3A is radially slideable along the upper surface of the disc 3B with respect to the stationary disc 3B for varying the shape of the resonator 3. The adjusting mechanism may be e.g. a metallic or ceramic adjustment rod 7 attached to the edge of the disc 3A by an insulator spacer 7A.

Figure 2:
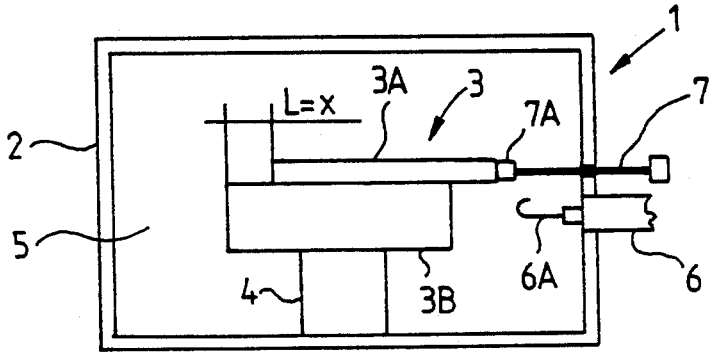

In FIG. 1, the discs 3A and 3B are positioned substantially coaxially, so that the basic dimensions of the resonator 3 can be the same as with a conventional cylindrical disc with a regular shape. The radial displacement L between the central axes of the discs 3A and 3B is thus zero, and the resonator is tuned to a resonance frequency $f_1$. When the resonance frequency is to be adjusted, the shape and field patterns of the resonator 3 are "distorted" by displacing the discs 3A and 3B radially with respect to each other, that is, by varying the radial displacement or offset L between the central axes of the discs. In the case of FIG. 2, L=x and the resonance frequency is $f_2$.

Figure 3:
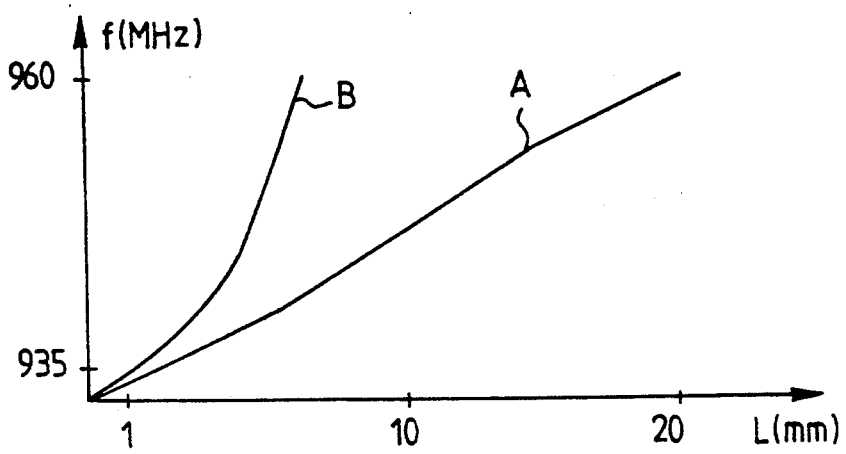
FIG. 3 shows the resonance frequency adjustment curves of a prior art resonator adjustable by a metal surface and the resonator structure shown in FIGS. 1 and 2 as a function of the adjusting distance L.

The curve A in FIG. 3 illustrates the resonance frequency f within the frequency range 935 MHz–960 MHz as a function of the radial displacement L in the resonator structure of FIGS. 1 and 2. As can be seen from FIG. 3, the resonance frequency adjustment curve A of the resonator according to the invention is very linear and very gently sloping as compared with e.g. the corresponding adjustment curve B of a conventional resonator structure adjustable by a metal surface, also shown in FIG. 3. The more linear and more gently sloping adjustment curve of the resonator according to the present invention allow considerably greater accuracy in resonance frequency adjustment.

The slope of the adjustment curve A can be affected by varying the difference between the thicknesses of the discs 3A and 3B: the greater the difference in the thicknesses the more gently sloping the adjustment curve A and the smaller the total adjusting range.

The invention has been described above by way of example by means of a specific embodiment. As is obvious to one skilled in the art on the basis of the above, the adjusting principle according to the invention can, however, be applied in all dielectric resonator structures in place of conventional adjusting methods. A few examples of possible structures are given in the above-mentioned articles [1]–[3].

The figures and the description related to them are only intended to illustrate the present invention. In its details the resonator structure according to the invention may vary within the spirit and scope of the attached claims.

I claim:

1. A dielectric resonator comprising:

a first cylindrical dielectric disc having a first planar surface;

a second cylindrical dielectric disc having a second planar surface, said first surface and said second surface being in contact with each other;

means for displaying one of said first and second discs with respect to the other one of said first and second discs in a radial direction, parallel to said first surface and said second surface such that a resonance frequency of said resonator is adjusted.

2. The resonator of claim 1, wherein said first disc is thicker than said second disc in a longitudinal axial direction.

3. The resonator of claim 1, wherein said first disc is stationary and said second disc is displayed with respect to said first disc by said displaying means.

4. The resonator of claim 1, further comprising a housing made of electrically conductive material and having a cavity defined by said housing, said resonator being positioned inside said cavity.

5. The resonator of claim 1, wherein said first disc and said second disc are made substantially of ceramic material.

6. The resonator of claim 1, wherein the resonance frequency is substantially in the microwave comprising:

7. A dielectric resonator comprising:

a first cylindrical dielectric disc having a first planar surface;

a second cylindrical dielectric disc having a second planar surface, said first surface and said second surface being in contact with each other, said first disc being thicker than said second disc in a longitudinal axial direction;

means for displacing one of said first and second discs with respect to the other one of said first and second disc in a radial direction, parallel to said first surface and said second surface such that a resonance frequency of said resonator is adjusted.

8. The resonator of claim 7, wherein said first discs is stationary and said second disc is displaced with respect to said first disc by said displacing means.

9. The resonator of claim 8, further comprising a housing made of electrically conductive material and having a cavity defined by said housing, said resonator being positioned inside said cavity.

10. The resonator of claim 7, wherein said first disc and said second disc are comprised substantially of ceramic material.

11. The resonator of claim 7, wherein the resonance frequency is substantially in the microwave range.

12. A dielectric resonator comprising:

a first dielectric structure having at least a first flat surface and a first thickness perpendicular to said first flat surface;

a second dielectric structure having at least a second flat surface and a second thickness perpendicular to said second flat surface, said first flat surface and said second flat surface being in contact with each other;

means for displacing one of said first and second structures with respect to the other one of said first and second structures in a direction parallel with said first flat surface and said second flat surface such that a resonance frequency of said resonator is adjusted.

13. The resonator of claim 12, wherein said first thickness is greater than said second thickness.

14. The resonator of claim 12, wherein said first structure and said second structure are both cylindrical discs.

15. The resonator of claim 12, wherein said first structure is held stationary and said second structure is displaced by said displacing means with respect to said first structure.

16. The resonator of claim 12, further comprising a housing having a cavity defined by said housing, said resonator positioned within said cavity.

17. The resonator of claim 12, wherein both said first structure and said second structure are comprised substantially of ceramic material.

18. The resonator of claim 12, wherein the resonance frequency is substantially in the microwave range.

* * * * *

UNITED STATES PATENT AND TRADEMARK OFFICE

CERTIFICATE OF CORRECTION

PATENT NO. : 5,315,274

DATED : May 24, 1994

INVENTOR(S) : Särkkä, Veli-Matti

It is certified that error appears in the above-indentified patent and that said Letters Patent is hereby corrected as shown below:

On the title page, delete item [22] and insert the following:

[22] PCT Filed: May 5, 1992

[86] PCT No.: PCT/FI92/00145

§ 371 Date: January 7, 1993

§ 102(e) Date: January 7, 1994

[87] PCT Pub. No.: WO 92/20116

PCT Pub. Date: November 12, 1992

Signed and Sealed this

Fourth Day of October, 1994

Bruce Lehman

*Attest:*

BRUCE LEHMAN

*Attesting Officer*

*Commissioner of Patents and Trademarks*